United States Patent [19]

Davis

[11] Patent Number: 4,536,283

[45] Date of Patent: Aug. 20, 1985

[54] INTEGRATED PROCESS FOR DEASPHALTING HEAVY OILS USING A GASEOUS ANTISOLVENT

[75] Inventor: Thomas A. Davis, Annandale, N.J.

[73] Assignee: Exxon Research and Engineering Co., Florham Park, N.J.

[21] Appl. No.: 642,501

[22] Filed: Aug. 20, 1984

[51] Int. Cl.[3] ..... C10C 3/00; C10C 3/08

[52] U.S. Cl. ..... 208/309; 208/351; 208/356; 208/362

[58] Field of Search ..... 208/309, 351, 356, 362

[56] References Cited

U.S. PATENT DOCUMENTS

| | | | |
|---|---|---|---|
| 2,141,361 | 12/1938 | Pilat et al. | 208/34 |
| 2,188,051 | 1/1940 | Lantz | 196/13 |
| 2,196,989 | 4/1940 | Henry et al. | 208/309 |
| 2,337,448 | 12/1943 | Carr | 196/13 |
| 2,631,966 | 3/1953 | Francis | 196/14.2 |
| 2,650,897 | 9/1953 | Woener | 208/309 |
| 2,669,538 | 2/1954 | Yurasko et al. | 196/14.46 |
| 2,950,244 | 8/1960 | Lawson, Jr. | 208/309 |
| 3,202,605 | 8/1965 | Redcay | 208/309 |
| 3,334,043 | 9/1965 | Ferris et al. | 208/309 |
| 3,481,865 | 12/1969 | Samuels | 208/309 |
| 3,516,928 | 6/1970 | King et al. | 208/309 |
| 4,017,383 | 4/1977 | Beavon | 208/309 |
| 4,054,512 | 10/1977 | Dugan | 208/309 |
| 4,179,362 | 12/1979 | Irani et al. | 208/321 |
| 4,191,639 | 3/1980 | Audeh et al. | 208/309 |
| 4,201,660 | 5/1980 | Zosel | 208/86 |

*Primary Examiner*—D. E. Gantz
*Assistant Examiner*—Helane Myers
*Attorney, Agent, or Firm*—E. Thomas Wheelock

[57] ABSTRACT

The present invention relates to a process for the recovery of hydrocarbon oils from other heavier oils such as vacuum residua and, more particularly, to an improved process for deasphalting petroleum oils containing those asphalts. In one aspect of the invention, the process treats a solvent which has contacted the heavy oil with a gaseous antisolvent to separate effectively and usually without distillation, the solvent from the extracted oil. The deasphalted oil product typically will have low metals contaminants and enhanced MCR. Utilities or energy requirements for the process may be improved over prior art processes.

20 Claims, 2 Drawing Figures

INTEGRATED PROCESS FOR DEASPHALTING HEAVY OILS USING A GASEOUS ANTISOLVENT

FIELD OF THE INVENTION

The present invention relates to a process for the recovery of hydrocarbon oils from other heavier oils such as vacuum residua and, more particularly, to an improved process for deasphalting petroleum oils containing asphalts. The process treats a solvent which has contacted the heavy oil with a gaseous antisolvent to separate effectively, and usually without distillation, the solvent from the extracted oil. The deasphalted oil product typically will have low metals contaminants and enhanced MCR. Utilities or energy equivalents for the process may be improved over prior art processes.

BACKGROUND OF THE INVENTION

In a typical refinery set up, crude oils are subjected to atmospheric distillation to separate lighter materials such as gas oils, kerosenes, gasolines, straight run naphtha, etc. from the heavier materials. The residue from the atmospheric distillation step is then distilled at a pressure below atmospheric. This latter distillation step produces a vacuum gas oil distillate and a vacuum reduced residual oil which often contains asphalts, resins, and heavy hydrocarbonaceous oil components. Upgrading vacuum resid is important in that these oils are often used as feedstocks for lubricating oil manufacture.

There are a number of techniques used for recovering the useful oils from various asphaltic petroleum residual oils. Many such processes involve the extraction of the oil with a deasphalting solvent such as propane, and thereafter separating and recovering the oil components from the solvent. In U.S. Pat. No. 2,950,244, a process for the extraction of petroleum residue containing asphalt is disclosed. The solvent utilized is a liquefied normally gaseous solvent, such as propane, which is maintained at a temperature between 100° and 200° F. and at a pressure sufficient to maintain the solvent in a liquid phase.

Variations of the deasphalting process using propane or similar short chain aliphatics as solvents are shown in U.S. Pat. No. 2,669,538 to Yurasko et al; U.S. Pat. No. 3,516,928 to King et al, issued June 23, 1970; U.S. Pat. No. 4,017,383 to Beavon, issued Apr. 12, 1977; and U.S. Pat. No. 4,201,660 to Szosel, issued May 6, 1980. King et al additionally suggests that carbon dioxide and ammonia, are under certain circumstance, equivalent as solvents to the disclosed lower alkanes, alkenes and their halogenated derivatives.

While propane is often used in known deasphalting operations, other solvents have been suggested. In U.S. Pat. No. 4,054,512, an asphalt-containing mineral oil is deasphalted by contacting the oil with liquid hydrogen sulfide. The use of liquid neopentane, at a temperature between 0° and 250° F., as the deasphalting solvent is shown in U.S. Pat. No. 3,334,043. In U.S. Pat. No. 2,337,448, heavy residual oil is deasphalted by a solvent selected from the group made up of ethane, ethylene, propane, propylene, butane, butylene, isobutane, and mixtures thereof.

Multi-stage solvent extraction techniques involving the use of one or more solvents are also known. In U.S. Pat. No. 3,658,665 a heavy oil is subjected to a two-stage extraction process. In the first stage, the heavy oil is contacted with a solvent and the mixture is thereupon subjected to additional solvent in a second zone. The second zone is maintained at a higher temperature than is the first solvent stage. In U.S. Pat. No. 4,017,383, a multistage deasphalting process is shown in which the recovery of the solvent from the extracted hydrocarbon is effected in a series of two or more pressure stages. The solvents are liquefied low molecular weight hydrocarbons, such as propane or isobutane.

Additionally there are a number of processes which use multiple or mixed solvents to deasphalt various oils. For instance, in U.S. Pat. No. 2,188,051 to Lantz, issued Jan. 23, 1940, the oil is contacted with a solvent preferably containing at least 75% of paraffinic hydrocarbons having less than seven carbon atoms. Ethane, propane, butane, isobutane, the pentanes, the heptanes, and the hexanes constitute the preferred solvents. The hydrocarbon solvent is first mixed with carbon dioxide for subsequent addition to the oils to be extracted.

In U.S. Pat. No. 2,631,966 to Francis, issued Mar. 17, 1953, liquid carbon dioxide and a variety of other solvents are used to separate various portions of the hydrocarbon feed. The solvents are members of two distinct classes. The first class is one whose members are completely miscible with liquid carbon dioxide but incompletely miscible with the oil to be extracted. The second class involves solvents which are incompletely miscible with carbon dioxide and also incompletely miscible with the feedstock to be extracted. Both sets of solvents are further defined to be those which do not form a solid salt with carbon dioxide at temperatures of 20° C. or higher. Included in the first class of solvents are such compounds as dichlorodiethyl ether, isopropanol, beta-ethoxy ethanol, diethylene glycol monoethyl ether and the like. Members of the second class of solvents include aniline, o-chloroaniline, m-chloroaniline, cresols and the like. The process generally includes the steps of adding the mixture of carbon dioxide and solvent to the oil and removing the carbon dioxide at various stages to effect separation of various types of hydrocarbon oils. U.S. Pat. No. 2,646,387 also to Francis, issued July 21, 1953, suggests an improvement to the process discussed above. The improvement identifies a method of recovering the solvent from the hydrocarbon oil by addition of liquid carbon dioxide to the solvent-oil mixture so as to form a solvent-carbon dioxide phase.

U.S. Pat. No. 4,179,362 to Irani et al, issued Dec. 18, 1979, suggests the separation of petroleum fractions into aromatic-rich and paraffinic-rich hydrocarbon streams by the use of methanol/water mixtures. The paraffin-rich stream is recovered as raffinate and aromatic-rich stream as the extract. After the extraction step, additional water is added to the extract and raffinate streams where the water acts as an antisolvent to effect separation of the hydrocarbon from the solvent. The water and methanol are then separated either by flash distillation or by using supercritical carbon dioxide as an extraction solvent.

In U.S. Pat. No. 4,191,639 to Audeh et al, issued Mar. 4, 1980, hydrocarbon oils such as residual petroleum oils are deasphalted and demetallized by contact with a liquid mixture of at least two of the components selected from hydrogen sulfide, carbon dioxide, and propane.

None of the above references are believed to suggest a process in which a heavy oil is deasphalted, the solvent extract is expanded or diluted using an expansion gas, such as carbon dioxide, to produce liquid product aromatics, and the remaining liquid phase is flashed to reconstitute the expansion gas, a solvent-containing stream, and a product saturate stream.

SUMMARY OF THE INVENTION

This invention relates to a combination deasphalting process in which a short chain aliphatic solvent is used to extract a deasphalted oil (DAO) from an asphalt-containing feedstock. The short chain aliphatic hydrocarbons may be selected from the group consisting of propane, butane, pentane, hexane and heptane. The solvent/DAO mixture is contacted or expanded with an expansion gas such as $CO_2$ at an elevated pressure to reduce the solubility of the aromatic portion of the DAO in the solvent and form an additional immiscible liquid phase. This new phase contains a substantial portion of the aromatic hydrocarbons found in the DAO. The remaining phase may be flashed to separate the expansion gas from the liquid. The remaining liquid typically will form two liquid phases; one phase will be the remaining saturate fraction of the DAO and the other will comprise solvent suitable for recycle to the extraction step. The DAO aromatics phase and the DAO saturates phase may additionally be subjected to evaporation steps to separate residual solvent for recycle to the extractor.

The expansion gas may be compressed for direct recycle to the solvent/DAO extract stream or introduced into the asphaltene phase comprising the extractor bottoms to separate residual solvent found in that stream.

This invention, in its broadest aspects, comprises the steps of introducing the expansion gas at an elevated pressure to a short chain aliphatic solvent which has been used to extract DAO from an asphalt-containing oil. The solvent/DAO/expansion gas mixture may then be separated into its constituent parts by flashing or distillation.

DESCRIPTION OF THE PREFERRED EMBODIMENTS

As discussed above, the commercial deasphalting of petroleum residual oils typically involves contacting residual oil in a countercurrent extractor with a low molecular weight paraffinic solvent having 3 to 7 carbon atoms. Generally, a treat ratio greater than 3 volumes of solvent to 1 volume of resid is needed to obtain good yields of deasphalted oil (DAO) because the oil is not highly soluble in the solvent. DAO is more soluble in heavier solvents, e.g., heptane, but heptane extracts compounds which are precursors to coke in later downstream refinery operations. Heptane is also usually more soluble in the asphaltene bottoms.

Figure 1:
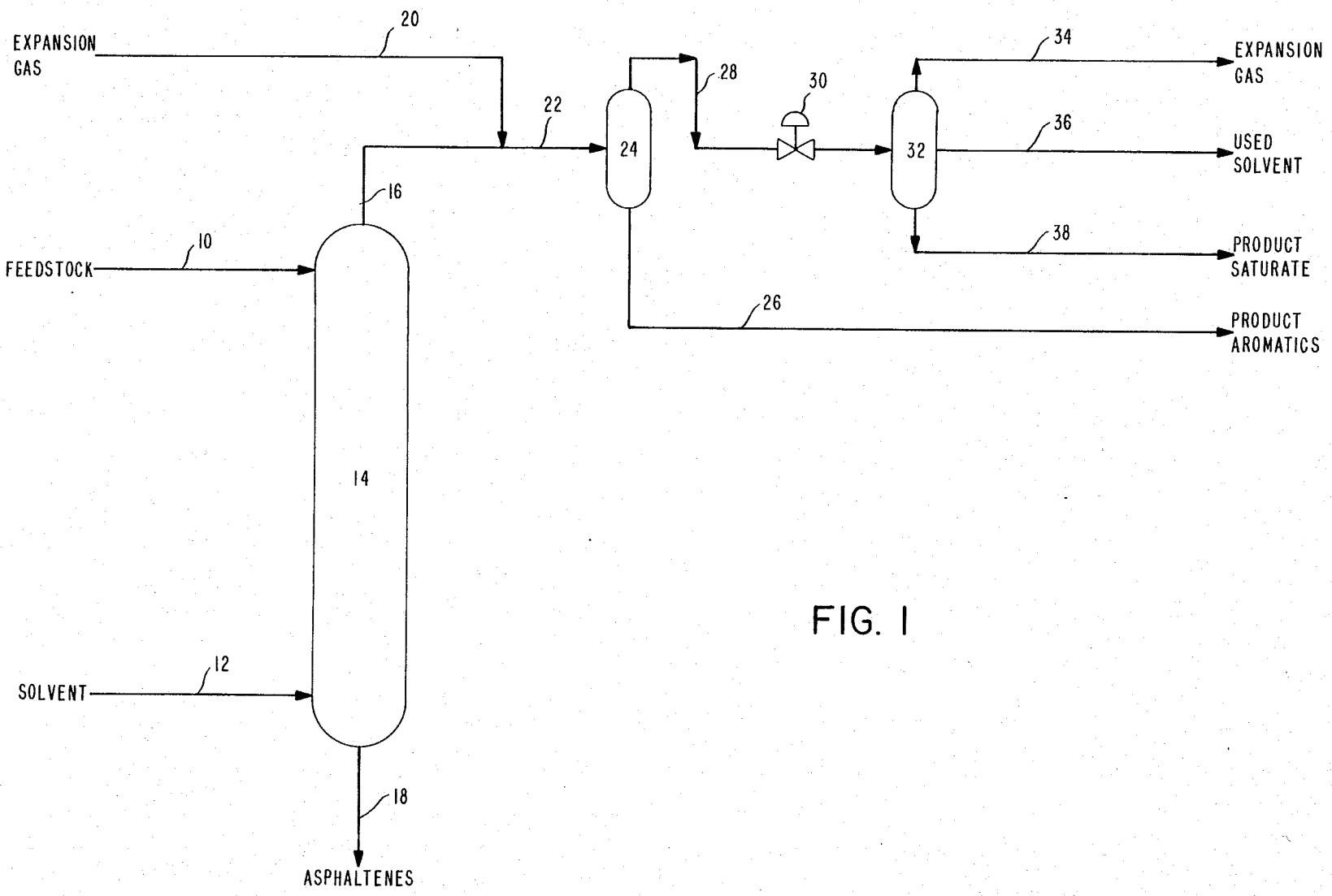
FIG. 1 depicts, in schematic form, the invention in a broad variation.

Referring to the process shown in FIG. 1, the initial step in the process comprises contacting a heavy oil feedstock in line 10 with a short chain aliphatic solvent, line 12. The feedstock may generally be any hydrocarbonaceous material containing more than an insignificant amount of an asphaltene. This process is especially suitable for heavy oils, such as raw crudes extracted from tar sands, shale oils, atmospherically distilled residual oils, and vacuum distilled residual oils. The solvent may be any short chain aliphatic hydrocarbon. Preferred solvents include those selected from the group consisting of propane, butane, isobutane, isopentane, neopentane, hexane, 2-methyl pentane, 3-methyl pentane, 2-ethyl butane, heptane, 2-, 3-methyl hexane, or 3-ethyl pentane. Most preferred solvents include propane, butane, pentane, hexane, heptane.

The solvent must be intimately mixed with the feedstock in a known manner such as the countercurrent contacting device 14 shown in FIG. 1. The volume ratio of feedstock to solvent will depend on a number of factors including the temperature of the contactor, chemical makeup of the feedstock, and choice of solvent. Typically, however, the volume ratio of solvent to feedstock will be greater than about 3:1, preferably in the range of 4:1 and 6:1. The solvent and feedstock obviously need to be well dispersed within each other. Choice of the continuous phase is at the option of the operator; however, the solvent typically would be the continuous phase. The difference in phase densities will cause the solvent to rise within contacting vessel 14, coalesce, and proceed out the top of the contactor in overhead line 16. The heavier materials, often multiple ring aromatic compounds known as asphaltenes comprise the bottom stream 18.

The upper stream 16 contains the solvent and the deasphalted oil (DAO). The expansion gas is introduced through line 20 in a known fashion. This expansion gas may be any gas which is miscible with the DAO, but preferably is carbon dioxide. Other gases which may be acceptable include methane and ammonia.

It is desirable to operate the contactor 14 and expansion gas line 20 at an elevated pressure. The pressure should be in the range of 100 psig to 3500 psig, preferably between 200 and 1500 psig.

Sufficient expansion gas should be added to the solvent/DAO stream to allow acceptable separation of the solvent from the various fractions of the DAO in the following steps. Typically, the weight ratio between expansion gas and DAO/solvent should range between 1:1 and 1:10; the more preferred ratios lay between 1:2 and 1:5. The yield of DAO appears to be a function of the amount of expansion gas added to the DAO/solvent. Furthermore, the CCN of the DAO improves with higher addition rates of expansion gas.

In any event, once the expansion gas and DAO/solvent streams are intimately mixed, the resulting stream 22 is carried to a separator 24 of known design. In this vessel, a lower phase comprising lighter aromatics and an amount of solvent is removed through the bottoms stream 26. The upper phase exits separator 24 through line 28 and is made up generally of the saturate fraction of the DAO, the majority of the solvent, and the dissolved expansion gas. This upper stream may be flashed in a Joule-Thompson (J-T) valve 30 and sent to a second separator vessel 32. Separator 32 should be adapted to handle a gas phase and two liquid phases. The pressure of separator 32 should be sufficient to flash substantially all the expansion gas contained in its feedstream. The expansion gas should exit the vessel through stream 34. The upper liquid phase, comprising used solvent, exits through line 36. The product saturates, the desired fraction of the original asphaltic feedstock, exit through line 38.

It should be understood that each of the hydrocarbon product lines 18, 26, and 38, contain hydrocarbons with a bit of residual solvent. Each of these products may, if desired, undergo additional treatment to recover whatever solvent may be remaining therein.

Figure 2:
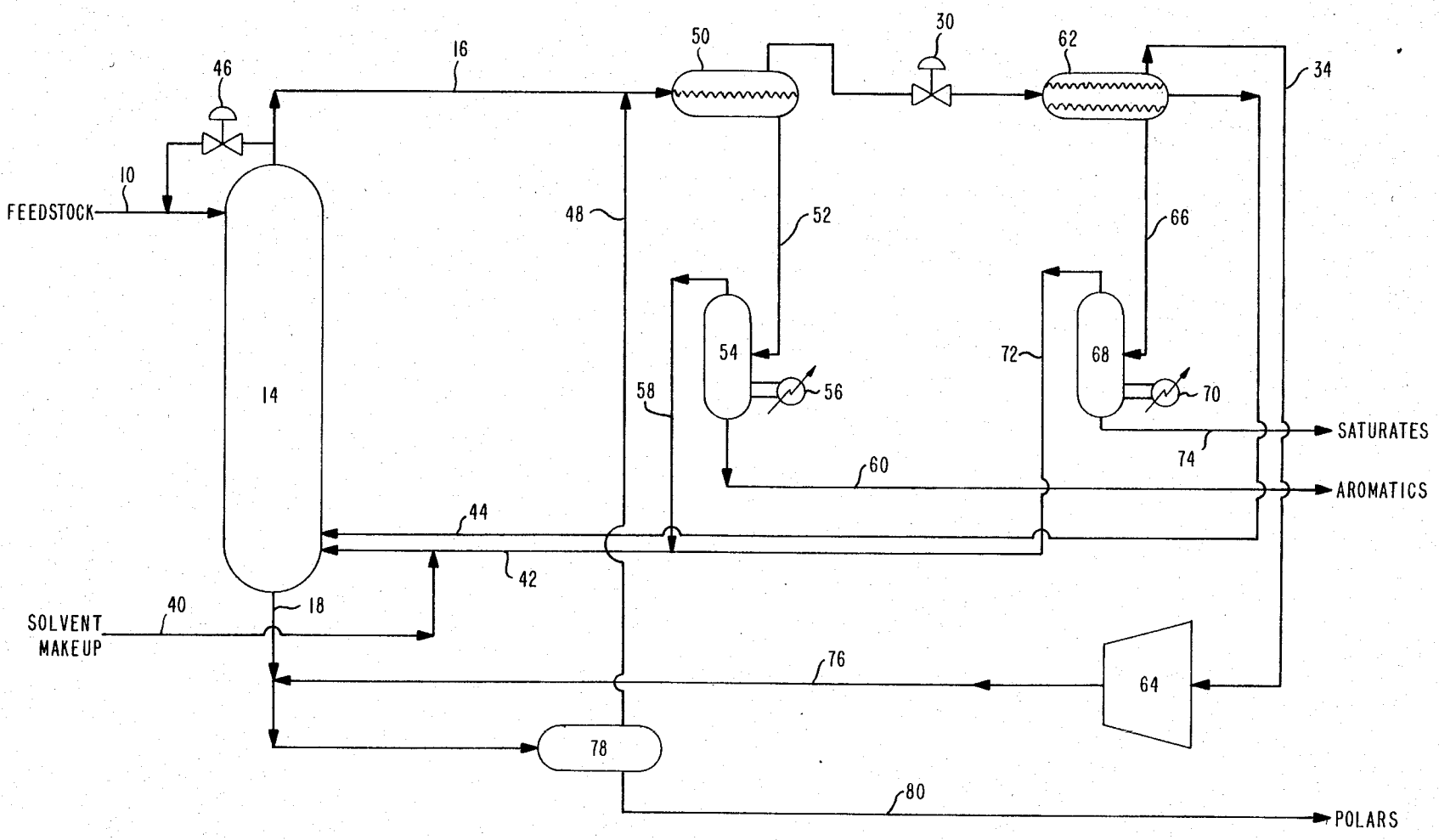
FIG. 2 schematically depicts a specific combination deasphalting process using solvent recycle.

The process shown in FIG. 2 illustrates a generally optimized process using the invention as described in FIG. 1, but is fully integrated to recycle most of the used materials. As in the process discussed above, the heavy oil feedstock is introduced into a countercurrent contactor 14 via line 10. Other known types of liquid-liquid contactors may, of course, be used instead of countercurrent contactor such as vessel 14. In this configuration, two recycle solvent lines of varying impurity are introduced into the lower end of contactor 14. A lower and more pure line is made up of solvent makeup through line 40 and the distilled solvent recycle line 42. The other less pure solvent is obtained from a separator and is introduced higher in a tower through separator solvent recycle line 44.

The heavy oil feedstock in line 10 may be mixed with a portion of the extract found in line 16. Addition of this solvent/DAO mixture through flow control valve 46 helps to lower the viscosity of the feedstock and allow better dispersion of the feedstock within the countercurrent contactor 14. It is additionally desirable to operate the countercurrent extractor with a temperature gradient, adding heat at the top, to overcome the increase in density that accompanies the oil loading of the extract. In any event, countercurrent contractor 14 operates in the same fashion as did the contactor in FIG. 1. A solvent/DAO extract leaves the tower via line 16 and a heavy (asphaltene or polar) stream leaves as the bottoms of the tower via line 18. The DAO/solvent mixture is mixed in a known manner with an expansion gas passing through line 48. This intimately mixed combination is then introduced into a first separator 50. In this separator two liquid phases are formed. The lower phase containing the aromatic fraction of the DAO is transported via line 52 to a simple still 54. This simple still 54 introduces heat via reboiler 56. The gaseous overhead comprising mostly pure solvent is recycled via lines 58 and 42 to the extractor 14. The bottom stream 60 contains most of the aromatics fraction of the DAO.

The upper liquid phase in first separator 50 is flashed through J-T valve 30 and the stream is introduced into secondary separator 62. An upper gaseous phase passing through line 34 is compressed for recycle in blower or compressor 64. The middle phase (or upper liquid phase) in secondary separator 62 is collected and returned via line 44 to extractor 14. The liquid in line 44 comprises mostly solvent with a few residual percent of unseparated DAO.

The bottom liquid phase in secondary separator 62 is sent via line 66 to another simple still 68. Reboiler 70 adds heat to the still to separate the solvent vapor in line 72 for inclusion in distilled solvent recycle line 42. The liquid bottoms from still 68 are passed through line 74 and comprise the majority of saturates found in the DAO extracted from the heavy oil feedstocks.

An advantageous method of recycling the expansion gas emanating from blower 64 is found in adding the compressed gas to the extractor bottoms line 18. Although the temperature and pressure of the expansion gas from the compressor are above the critical point, a portion of the expansion gas dissolves in the bottoms causing separation of some of the solvent. The expansion gas that remains dissolved in the polar or asphaltene stream lowers the viscosity and increases the volatility, thus facilitating solvent removal from the asphaltene. The mixed polars/expansion gas stream is then sent to a bottom separator 78. The expansion gas and solvent comprising the upper phase in separator 78 flow through line 48 to mix with the extract coming from the top of extractor 14. The lower phase in separator 78 is a heavy asphaltene phase which may be removed from the unit via line 80 for further use. Bottoms separator 78 may be heated to facilitate removal of the $CO_2$/solvent stream (which may contain some DAO) for more efficient recycle.

Additionally to better understanding of this invention is the following example which is included here for the purpose of illustration only and is not intended to be a limitation.

EXAMPLE

A 91 gram sample of Heavy Arab Vacuum Resid (HAVR), having a 21.3% MCR and containing 43 ppm Ni and 180 ppm V, was extracted with 231 grams of butane. The extraction yielded a 59 gram asphaltene fraction having a 27.1% MCR and containing 63 ppm Ni and 244 ppm V.

The extract phase contained the remainder of the HAVR feedstock, i.e., the DAO, amounting to about 35% of the feedstock weight.

The extract solvent/DAO was divided into three portions. A first was pot-distilled and yielded a solvent-free DAO with 8.7% MCR and containing 7 ppm Ni and 24 ppm V.

A second portion containing 22.9 grams of butane and 5.3 grams of oil was subjected to a $CO_2$ introduction at 21° C. and 1700 kPa (247 psig) until it had absorbed 6 grams of the gas. The lower aromatics-containing layer was formed. The oil in the layer weighed 0.81 grams and bad an MCR of 18.1%. The metals content was 16 ppm Ni and 86 ppm V. The oil in the upper phase (30% yield) had an MCR of 6.1% and contained 3.6 ppm Ni and 9.8 ppm V.

A third portion containing 22.2 grams of butane and 5.2 grams of oil was expanded with $CO_2$ at 21° C. and 2700 kPa (392 psig) until it had absorbed 11 grams of the gas. The oil in the lower aromatics-containing layer weighed 1.1 grams and had an MCR of 18.4%. The metals content was 18 ppm Ni and 64 ppm V. The oil in the upper phase (26% yield) had an MCR of 5.4% and contained 2.4 ppm Ni and 7.2 ppm V.

It is clear, therefore, that expansion with $CO_2$ provided a DAO with significantly lower MCR values, Ni and V contents when compared with a DAO separated from the solvent by simple distillation. It is also clear that the MCR values of the product DAO improved as additional $CO_2$ was added to the DAO/solvent mixture.

The above example illustrates the effectiveness of the process of the invention, both from its ability to produce DAO's with decreased MCR's as well as reduced heavy metals content. Thus, and as will be appreciated by those skilled in the art, the use of expansion gases to contact the solvent DAO mixture exiting a contactor used to extract DAO from asphaltene-containing feedstocks is unique. The processes disclosed herein are seen as providing a method by which large capital cost in distillation towers may be avoided, along with their concomitant high utility cost.

I claim as my invention:

1. A process for separating a liquid feedstream comprising a solvent selected from the group consisting of propane, butane, isobutane, pentane, isopentane, neopentane, hexane, 2-methyl pentane, 3-methyl pentane, 2-ethyl butane, heptane, 2-, 3-methyl hexane, or 3-ethyl pentane and a deasphalted oil containing aromatics and saturates comprising the steps of:

introducing a sufficient amount of a gaseous expansion gas into said liquid feedstream to cause it to form an upper liquid phase and a lower phase comprising aromatics, separating the upper liquid phase from the lower liquid phase, and flashing said separated upper liquid phase to produce an expansion gas phase, a second upper liquid phase comprising solvent, and a second lower liquid phase comprising saturates.

2. The process of claim 1 wherein said solvent is selected from the group consisting of propane, butane, pentane or hexane.

3. The process of claim 1 wherein the expansion gas is selected from the group consisting of methane, ammonia and $CO_2$.

4. The process of claim 3 wherein the expansion gas is $CO_2$.

5. The process of claim 1 additionally comprising the step of extracting a heavy oil stream with said solvent to produce the solvent and deasphalted oil liquid stream.

6. The process of claim 5 wherein the heavy oil feedstock is selected from the group consisting of raw tar sand extracts, shale oils, atmospheric residual oils, and vacuum distilled residual oils.

7. The process of claim 6 wherein the heavy oil feedstock is vacuum distilled residual oil.

8. The process of claim 5 wherein a stream comprising asphaltene is recovered.

9. The process of solvent deasphalting a heavy oil feedstock and recycling the solvent comprising the steps of:

contacting the heavy oil feedstock with at least one solvent-containing stream to produce an extract stream containing solvent and deasphalted oil and a heavy stream containing heavy polar material, introducing a sufficient amount of a gaseous expansion gas into said extract stream to cause it to form a first upper liquid phase and a first lower liquid phase comprising solvents and aromatics, separating the first upper liquid phase from the first lower liquid phase and flashing it to produce an expansion gas phase, a second upper liquid phase comprising solvent, and a second lower liquid phase comprising saturates, separating the first lower liquid phase into a stream comprising aromatics and a stream comprising solvent for recycle to the extraction step, separating the second lower liquid phase into a stream comprising saturates and a stream comprising solvent for recycle to the extraction step, compressing the expansion gas phase for recycle to said extract stream.

10. The process of claim 9 wherein a portion of the extract stream is blended with the feedstock heavy oil to reduce its viscosity.

11. The process of claim 9 wherein the lower first liquid phase comprising aromatics is separated by a simple still to produce the recycle solvent stream and the aromatic stream.

12. The process of claim 9 wherein the second lower liquid phase comprising saturates is separated in a simple still to produce a recycle solvent stream and a stream comprising saturates.

13. The process of claim 9 wherein the compressed expansion gas phase leaving the compressor is first mixed with a bottoms stream comprising asphaltenes leaving the extraction step prior to recycling the expansion gas to the extract stream.

14. The process of claim 13 wherein the expansion gas asphaltene mixture is separated to produce a stream comprising polars and a stream comprising solvent and oil for contacting with the extract stream.

15. The process of claim 9 wherein the solvent is selected from the group consisting of propane, butane, isobutane, pentane, isopentane, neopentane, hexane, 2-methyl pentane, 3-methyl pentane, 2-ethyl butane, heptane, 2-, 3-methyl hexane, 3-ethyl pentane.

16. The process of claim 15 wherein the solvent is selected from the group consisting of propane, butane, pentane, hexane, or heptane.

17. The process of claim 9 wherein the expansion gas is selected from the group consisting of methane, ammonia and $CO_2$.

18. The process of claim 17 wherein the expansion gas is $CO_2$.

19. The process of claim 9 wherein the heavy oil feedstock is selected from the group consisting of raw tar sand extracts, shale oils, atmospheric residual oils, and vacuum distilled residual oils.

20. The process of claim 19 wherein the heavy oil feedstock is vacuum residual oil.

* * * * *